US010850879B2

(12) United States Patent
Bellante

(10) Patent No.: US 10,850,879 B2
(45) Date of Patent: Dec. 1, 2020

(54) MACHINE AND METHOD FOR SECONDARY PACKAGING OF ARTICLES

(71) Applicant: CAMA1 S.p.A., Milan (IT)

(72) Inventor: Daniele Bellante, Garbagnate Monastero (IT)

(73) Assignee: CAMA1 S.P.A., Milan (IT)

( * ) Notice: Subject to any disclaimer, the term of this patent is extended or adjusted under 35 U.S.C. 154(b) by 487 days.

(21) Appl. No.: 14/280,189

(22) Filed: May 16, 2014

(65) Prior Publication Data

US 2014/0352261 A1 Dec. 4, 2014

(30) Foreign Application Priority Data

Jun. 4, 2013 (EP) ..... 13170498

(51) Int. Cl.
*B65B 43/00* (2006.01)
*B65B 35/54* (2006.01)
(Continued)

(52) U.S. Cl.
CPC ..... *B65B 35/54* (2013.01); *B65B 5/00* (2013.01); *B65B 5/024* (2013.01); *B65B 5/106* (2013.01);
(Continued)

(58) Field of Classification Search
CPC ..... B65B 5/024
(Continued)

(56) References Cited

U.S. PATENT DOCUMENTS 3,858,519 A * 1/1975 Masino ..... B65B 35/24 198/524
4,167,994 A * 9/1979 Seragnoli ..... B65B 19/228 198/457.03
(Continued)

FOREIGN PATENT DOCUMENTS

DE 19838076 2/2000
EP 695 703 2/1996
(Continued)

OTHER PUBLICATIONS

European Search Report from European Application No. EP 13170498 completed Jan. 9, 2014.

*Primary Examiner* — Andrew M Tecco
*Assistant Examiner* — Eyamindae C Jallow
(74) *Attorney, Agent, or Firm* — Dorsey & Whitney LLP

(57) ABSTRACT

A side loading packaging machine for packaging articles in containers including: a section for forming containers starting from die-cuttings, comprising at least one feeding device, a loading section, a closing section, substantially aligned along a longitudinal axis of the machine; a conveyor equipped with transportation members configured to carry at least one of said containers, wherein said conveyor includes a motor arranged to drive the advance of said transportation members or groups thereof in an independent manner, and the machine operates with: a continuous formation of boxes, said feeding member working with a continuous movement and with a constant rate over time, and said transportation members advancing with a continuous movement at said forming section; and a static loading, said transportation members being stationary during the loading of articles into the containers.

12 Claims, 3 Drawing Sheets

(51) Int. Cl.

| | |
|---|---|
| ***B65B 51/02*** | (2006.01) |
| ***B65B 43/26*** | (2006.01) |
| ***B65B 39/00*** | (2006.01) |
| ***B65B 7/16*** | (2006.01) |
| ***B65B 5/00*** | (2006.01) |
| ***B65B 35/40*** | (2006.01) |
| ***B65B 35/02*** | (2006.01) |
| ***B65B 5/02*** | (2006.01) |
| ***B65D 85/62*** | (2006.01) |
| ***B65B 5/10*** | (2006.01) |
| ***B65D 77/04*** | (2006.01) |
| *B65B 65/02* | (2006.01) |
| *B65D 85/804* | (2006.01) |
| *B65B 29/02* | (2006.01) |

(52) U.S. Cl.
CPC ..... *B65B 7/16* (2013.01); *B65B 35/02* (2013.01); *B65B 35/405* (2013.01); *B65B 39/007* (2013.01); *B65B 43/26* (2013.01); *B65B 51/02* (2013.01); *B65D 77/04* (2013.01); *B65D 85/62* (2013.01); *B65B 29/022* (2017.08); *B65B 65/02* (2013.01); *B65D 85/8043* (2013.01)

(58) Field of Classification Search
USPC ..... 53/456, 458, 467, 468, 558, 566
See application file for complete search history.

(56) References Cited

U.S. PATENT DOCUMENTS 4,215,525 A * 8/1980 Nigrelli ..... B65B 5/068 53/207
4,663,914 A * 5/1987 Ganz ..... B65B 27/04 53/233
4,752,175 A * 6/1988 Lichti ..... B65G 1/127 198/368
4,850,542 A * 7/1989 Rechsteiner ..... H01F 41/022 198/690.1
5,065,856 A * 11/1991 Reid ..... B65B 11/10 198/419.3
5,175,976 A * 1/1993 Petry ..... B65B 39/14 53/252
5,713,187 A * 2/1998 Peterson ..... B65B 43/305 221/202
5,722,218 A * 3/1998 Lerner ..... B65B 43/123 198/819
5,810,487 A * 9/1998 Kano ..... B41J 3/28 400/83
5,937,620 A * 8/1999 Chalendar ..... B65B 59/005 53/168
6,019,213 A 2/2000 Schubert
6,499,280 B1 * 12/2002 Tsutsui ..... B65B 43/52 141/169
6,713,902 B2 * 3/2004 Chitayat ..... G01D 5/145 310/12.16
2004/0162207 A1 * 8/2004 Ruf ..... B65B 43/185 493/309
2005/0061620 A1 3/2005 Bonnain et al.
2012/0031741 A1 * 2/2012 Ishino ..... A47F 10/06 198/793
2012/0233967 A1 * 9/2012 Bellante ..... B25J 9/0084 53/443

FOREIGN PATENT DOCUMENTS

EP 0695703 A1 * 2/1996 ..... B65G 7/082
EP 2287076 2/2011
EP 2388197 11/2011
GB 701410 12/1953
GB 1210097 10/1970
WO WO 9726188 A1 * 7/1997 ..... B65B 5/024
WO WO 03/105324 12/2003
WO WO 2007/120563 10/2007

* cited by examiner

MACHINE AND METHOD FOR SECONDARY PACKAGING OF ARTICLES

PRIORITY CLAIM

This application claims priority to European Patent Application No. 13170498.3 filed on 4 Jun. 2013, the entire contents of which are incorporated herein by this reference.

TECHNICAL FIELD

Embodiments of the present invention relate to the field of secondary packaging, such as a machine and a method for side loading packaging.

BACKGROUND

Side loading secondary packaging machines of the prior art substantially operate according to either the principle of continuous loading or the principle of intermittent loading.

These machines generally comprise: a containers forming section starting from die-cuttings, by means of at least one feeding device; a loading section for loading the articles into the containers, a closing section of the containers. Said sections are aligned on a longitudinal direction of the machine.

A continuous motion machine comprises a main (master) conveyor for transportation of the containers, first empty and subsequently full of articles, from the forming section through the loading section, and up to the closing section. Said master conveyor imposes a constant advancing speed of the containers synchronised with the feeding device. Said device puts the containers on the conveyor distanced from one another by a given pitch p.

In the loading section of the machine, said main conveyor runs side by side of an auxiliary conveyor previously loaded with the articles, which are suitably divided into batches distanced from one another by said pitch p.

Along at least a portion of the loading section, the main conveyor and the auxiliary conveyor travel side by side at the same speed, so that a batch of articles on said auxiliary conveyor faces a corresponding container on the master conveyor. The loading is effected by suitable insertion members and is made while the two conveyors are running.

A machine operating according to this technique is described, for example, in EP-A-2 388 197.

An advantage of this approach is that the main mechanical components amongst which the feeding device, conveyors and insertion members, operate continuously. Such a condition is less severe for the mechanics. Moreover, the machine is found to be suitable for managing different formats. The presence of the two conveyors however renders the machine quite costly and bulky, especially in length. Moreover, a precise timing of articles is required by the continuous loading and, consequently, it is necessary to provide timing devices that increase the cost.

A machine with static or intermittent loading operates, on the other hand, in the following way. The master conveyor stops in the loading section of the machine, so that the insertion of the articles into the containers occurs in a static manner, i.e. while the containers are stopped. An auxiliary conveyor for the articles, also having intermittent movement, can be equally provided. This technique simplifies the loading operation and does not require a precise timing between the articles and the containers, but imposes an intermittent movement on the master conveyor and consequently also on the feeding group, which needs be coordinated with said master conveyor. This proves to be particularly burdensome for the mechanical components of the feeding group, which typically comprises an "orbital" rotary device with eccentric masses, and is highly stressed by repeated stops and restarts. In substance, the formation of boxes in an intermittent machine is affected by the intermittence dictated by the loading operation, and thus strictly depends upon loading format and mode.

SUMMARY

One or more embodiments of the invention aim to improve the previously described prior art. Indeed, there is an ongoing need for improvement, which includes not only the flexibility in the change of format, but also the reduction of the cost and size of the machine.

The applicant has thought about making a machine with a single conveyor, suitable for allowing the continuous formation of containers and static (or intermittent) loading, so as to overcome the aforementioned drawbacks.

The purposes of one or more embodiments of the invention are thus achieved with a side loading machine for packaging articles in containers, comprising:

a containers forming section from die-cuttings, said section comprising at least one feeding device;

a loading section of the articles into the containers, a closing section of the containers, said sections being substantially aligned along a longitudinal direction of the machine;

also comprising a conveyor that extends without solution of continuity along a closed two way path between said forming section and said closing section, wherein said conveyor comprises a plurality of transportation members, each of said transportation members being configured to carry at least one container, and comprises motor means arranged to drive the forward movement of said transportation members or of groups of said transportation members independently from one another along at least part of said path, and wherein said machine operates with:

a continuous formation of boxes, said at least one feeding device operating with a constant rate over time, and said transportation members advancing with continuous movement in correspondence of the forming section, and with:

a loading in a static condition, said transportation members being stationary during the loading of articles into the containers.

The loading section advantageously comprises at least one insertion group arranged for inserting articles directly from an accumulation area into respective containers located on the conveyor and in correspondence of the loading section.

Said conveyor is preferably a conveyor with a closed path that extends without solution of continuity from the containers forming section to the closing section, comprising a forward branch running from the forming section to the closing section, and a return branch running from the closing section to the forming section.

Said motor means, and a suitable control system, are arranged to drive the advance movement of a plurality of transportation members, or groups of the same transportation members, in an independent manner along at least part of the path of the conveyor. Groups of transportation members are also called "trains" and, accordingly, the conveyor is also termed "multiple trains". The term "train" denotes a certain number of transportation members which, at least for a portion of the conveyor, keep the same distance from one another and move together like cars of a train. Said trains can be controlled in an independent manner, so that, for example, a first train can advance with continuous movement while a second train is stopped or advances with an intermittent movement. Moreover, a same train can advance selectively with continuous or intermittent movement.

Said transportation members, in some embodiments, are represented by container-carrying pockets or cells. In the technical language, the transportation members are also called "movers".

The containers, in a preferred application, are represented by cardboard cases.

It should be noted that the forming section of the containers operates continuously with the advantage of a reduced stress of the mechanical components and particularly of the feeding device.

In particular, said at least one feeding device operates with a constant rate over time. The term of rate denotes the number of containers taken from the store and placed on the conveyor per time unit (for example 200 pieces/min). Said value remains constant during the operation of the machine; in other words said at least one feeding device operates without solution of continuity, unlike intermittent machines of the prior art where said device is also intermittent.

The loading, on the other hand, is carried out statically, with the insertion of the articles into stationary containers. Moreover, the conveyor is unique; therefore the embodiments of the invention avoid the provision of two side by side conveyors, thus reducing the cost and size.

Hence, some of the advantages of one or more embodiments of the invention can be summarised as follows:

- compared to a conventional machine with a continuous movement, the machine of one or more embodiments of the invention is simpler and smaller, it does not require two side-by-side conveyors synchronised with one another, it does not require product timing devices, it adapts more easily to changes of format, possibly also through the replacement of the transportation members of the conveyor;
- compared to a conventional machine with an intermittent movement, the machine of one or more embodiments of the invention has the big advantage of reducing the stress on the feeding group; therefore it reaches high operation speeds more easily, and makes the forming operation substantially independent from the loading operation.

Further preferred features of one or more embodiments of the invention are as follows.

Said loading section preferably comprises a plurality of insertion members, each of said insertion members being arranged so as to push articles from a respective accumulation area directly into a respective container. More preferably, said accumulation area is represented by the end section of feed tracks. The articles in each track can be arranged in a single row or several rows.

According to a preferred embodiment of the invention, said closing section comprises a first sub-section for application of glue, and a second sub-section for closure of the edges of the containers. In such a case, and even more preferably, said transportation members or groups of transportation members of the conveyor are driven with a continuous movement through the first sub-section, and are driven with an intermittent movement through the second sub-section. The applicant has found that a continuous advance movement is preferable when applying the glue, whereas an intermittent movement is advantageous during the closing operation.

Preferably, the conveyor comprises at least four channels. By this term, it is denoted that at least four transportation members or groups of transportation members (trains) can be controlled in an independent manner. Hence, at any moment of time, the four channel conveyor is able to drive:

- a first train located in the forming section, and that advances with a continuous movement coordinated to the feeding group;
- a second train located in the loading section, stopped during the loading operation by means of the insertion members;
- a third train and a fourth train, located respectively in the glue spraying sub-section and in the edge closing sub-section, wherein the third train preferably advances with continuous movement during the spraying of glue, whereas the fourth train preferably advances with intermittent movement coordinated with fixed or mobile members dedicated to the closing of the edges.

By using a four channels system, the trains of the conveyor are in a number of four or a multiple of four. For example it is appropriate to have at least eight trains, so that while four trains operate in the forward branch of the conveyor, another four are already in the return branch and ensure the continuity of the operation of the machine.

Advantageously, the multiple train conveyor is implemented with one of the following techniques.

A first technique is the conveyor known from EP 695 703. In this case, each train comprises a certain number of transportation members secured to a respective motorised belt. Typically the transportation members are embodied as pockets. The conveyor comprises at least two motors that control two separate belts and two respective groups of pockets. For example a four channel conveyor as mentioned above can be realized with four belts each provided with its own independent motor. Each belt carries one train or, preferably, several trains of pockets.

A second technique is a linear sliders conveyor, which is known in the art and described in patent literature for example in WO 03 105324. In this case, the conveyor comprises a certain number of sliders controllable in an independent manner by means of linear motors. For example, each slider comprises reactive elements interacting with active elements incorporated in the path of the conveyor, obtaining the desired linear advance movement with variable speed. Normally, the reactive elements associated with the sliders are represented by magnets and the active elements incorporated in the path are represented by coils powered with an electric current. Each of the sliders carries one or more transportation members of the containers like pockets or the like.

In said second embodiment, it should be noted that the sliders dynamically form the previously mentioned trains. A certain number of sliders, at least for a portion of the path, can remain stationary or advance with the same speed, thus forming a train.

In a particularly preferred embodiment, the machine comprises an accumulation area for receiving and accumulating the articles, and said area comprises a track or a plurality of parallel tracks. Consequently, the input of articles is given by a row or by a certain number of rows of articles. Even more preferably, the insertion group comprises a mobile member, which is typically a mobile carriage or an equivalent member, arranged to process a number N of articles for each row, inserting said articles directly from the aforementioned tracks into the containers located in the loading area.

Preferably, said mobile member acts by positively pushing an N-th article of each row formed in the accumulation area, so as to push N articles (from the first to said N-th article) into the respective container. The term of positive pushing denotes that said mobile member grabs the aforementioned N-th article, for example with a gripper or an equivalent means, without moving it from the row.

Said preferred embodiment has shown to be particularly suitable for packaging capsules for the preparation of beverages, typically for coffee. Many applications on the market require the packing of said capsules in linear cases with a 1×N format, i.e. one row of capsules per each case. Frustoconical capsules are advantageously alternated by adjoining base to vertex, in order to save space, said arrangement being however not essential for the embodiments of the present invention.

With reference to said preferred application, a machine for packaging coffee capsules according to one or more embodiments of the invention is fed by a number M of tracks, for example four tracks, which form respective rows of capsules in the accumulation area. A suitable carriage, for each loading cycle, transfers M rows of N capsules each into as many cases, whereas said cases stay on a train of the conveyor, in the loading area of the machine facing the accumulation area. Once the loading operation is completed, the train of conveyor transfers the full cases to the closing section downstream, whilst a new group of M empty cases, carried by another train, enters the loading station.

Another aspect of the invention consists of a method for packaging articles into containers, with a side loading, according to the attached claims.

The advantages of the embodiments of the invention shall become clearer with the help of the following detailed description which is given as an example and not for limiting purposes.

DETAILED DESCRIPTION

Figure 1:
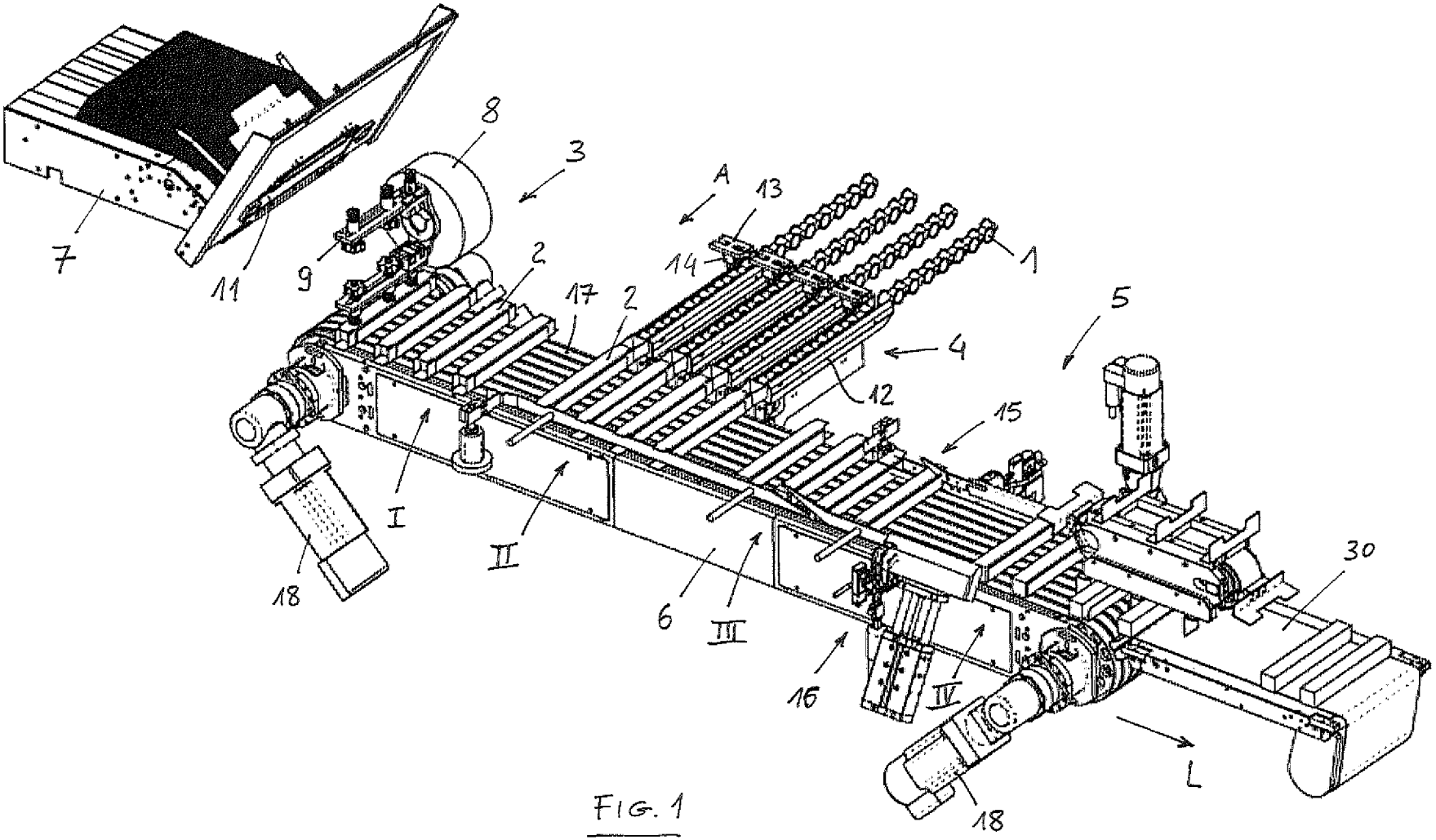
FIG. 1 shows the main components of a packaging machine according to a first embodiment of the invention.

FIG. 1 shows the main components of a machine for packaging coffee capsules 1 inside containers which are represented, according to this non-limitative example, by linear cases 2.

The machine comprises a section 3 for forming the cases 2, a loading section 4 and a closing section 5. Said sections 3, 4 and 5 are substantially aligned along a longitudinal direction, or longitudinal axis, of the machine denoted with L.

The machine comprises a linear conveyor, globally indicated with reference numeral 6, that substantially extends from the forming section 3 to the closing section 5, passing through the loading section 4.

The forming section 3 generates the cases 2 starting from cardboard die-cuttings housed in a store 7.

The framework of the machine is not illustrated, said framework supporting said sections 3, 4 and 5, the conveyor 6, the store 7, the other components that shall be described in the rest of the description and the auxiliary components.

Figure 3:
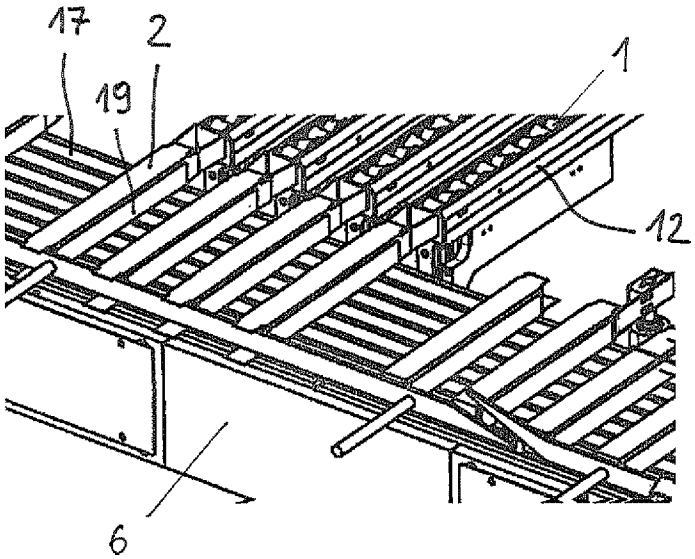
FIGS. 2, 3 and 4 concern details of FIG. 1.
Figure 4:
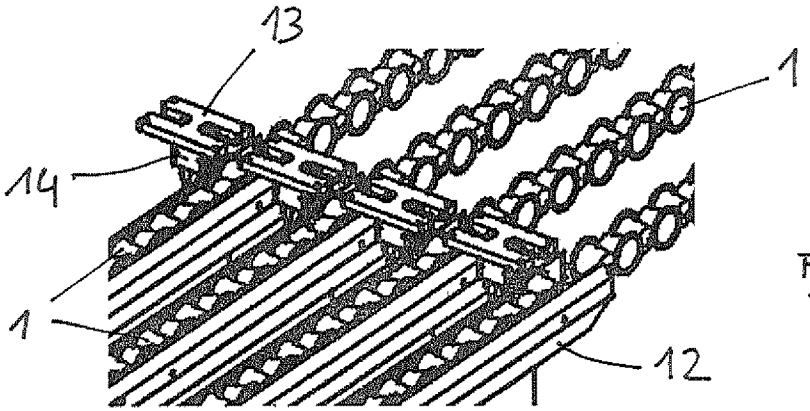
Figure 2:
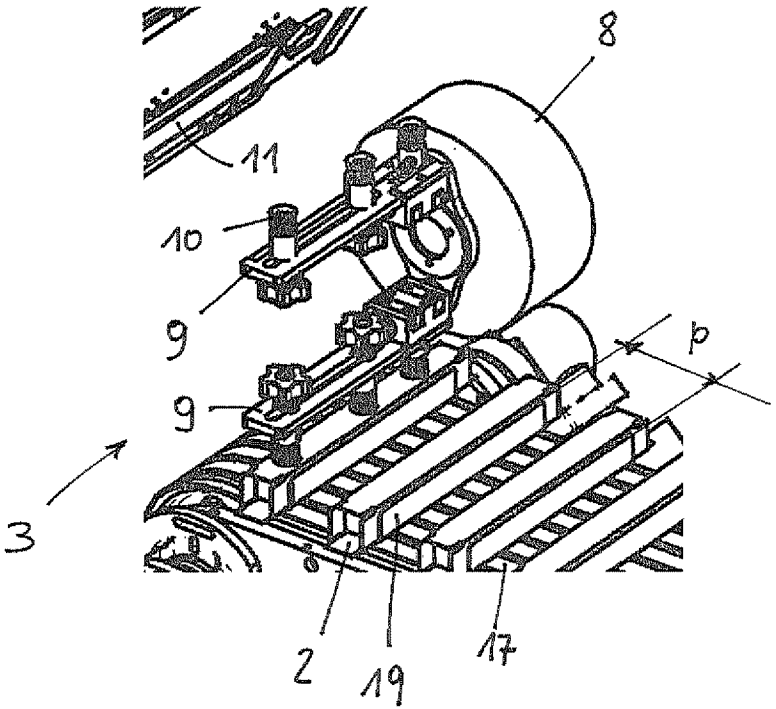

The machine is now described also with reference to the FIGS. 2-4, showing the forming section (FIG. 2) and the loading section (FIGS. 3-4) in a greater detail.

Said forming section 3 comprises a feeding device 8 that substantially forms the cases 2 to release them to transportation members of the underlying conveyor 6. Said device 8, in the illustrated example, comprises orbital gripping members 9 equipped with suction cups 10. Each of said gripping members 9 is configured to take a die-cutting 11 from the store 7 to form one of the cases 2 (FIG. 2). The movement of the orbital holding member 9 places a case 2 in a transportation member of the conveyor 6, for example a pocket 19 as represented in the figures. A feeding device of this type is per se known and therefore does not require a detailed description.

The loading section 4 is set alongside an accumulation area of the capsules 1. Said accumulation area is represented by the end portions of four feed tracks 12. Said loading section 4, moreover, comprises an insertion group that is represented by a mobile carriage 13. Said mobile carriage 13 is arranged so as to insert rows of capsules 1 from the feed tracks 12 into respective cases 2 located on the conveyor 6. The mobile carriage is only partially shown.

Advantageously, said mobile carriage 13 comprises a plurality of pincer members 14, each pincer member being able to grab the edge of a capsule 1 in the N-th position of one of the rows formed in the tracks 12. By grabbing the edge of a capsule, the carriage 13 can positively push a row of capsules, from a first capsule (machine side, close to the case) up to said N-th capsule (input side) into an open case 2. The direction of the active stroke of the carriage 13 is indicated by the arrow A. The carriage 13 can be realized as a single translating member (single carriage) or, in other embodiments, many carriages can be provided, for example a carriage for each track 12. Said pincer members 14 can be electromechanically or pneumatically driven.

The closing section 5 preferably comprises a sub-section 15 for applying glue and a sub-section 16 for closing the edges of the cases.

The conveyor 6 extends without solution of continuity from the forming section 3, through the section 4 and up to the closing section 5, with a closed path that comprises a forward branch and a return branch.

Said conveyor 6, in this example, substantially comprises four pairs of belts 17, which are moved by four respective motors 18 in an independent manner. Two of the motors 18 can be seen in FIG. 1. It may be noted that two motors 18 are mounted coaxially at each end of the conveyor 6, given that such constructive details are not essential for the embodiments of the invention.

Each pair of belts 17 carries one or more groups (trains) of pockets 19, each pocket 19 being able to receive one of the cases 2. Each group or train of the conveyor 6 comprises at least one pocket 19 or, preferably, a plurality of said pockets, so as to transport several cases.

In FIG. 1 four trains of pockets 19 can be seen in the forward branch of the conveyor 6. Said four trains are indicated respectively with the symbols I, II, III and IV, and comprise four cases each. Each of said four trains is fixedly connected to a pair of belts 17, and is moved by one of the four motors 18 in an autonomous manner with respect to the others. Other trains of pockets are found on the return branch of the conveyor 6, facing downwards in FIG. 1.

Figure 5:
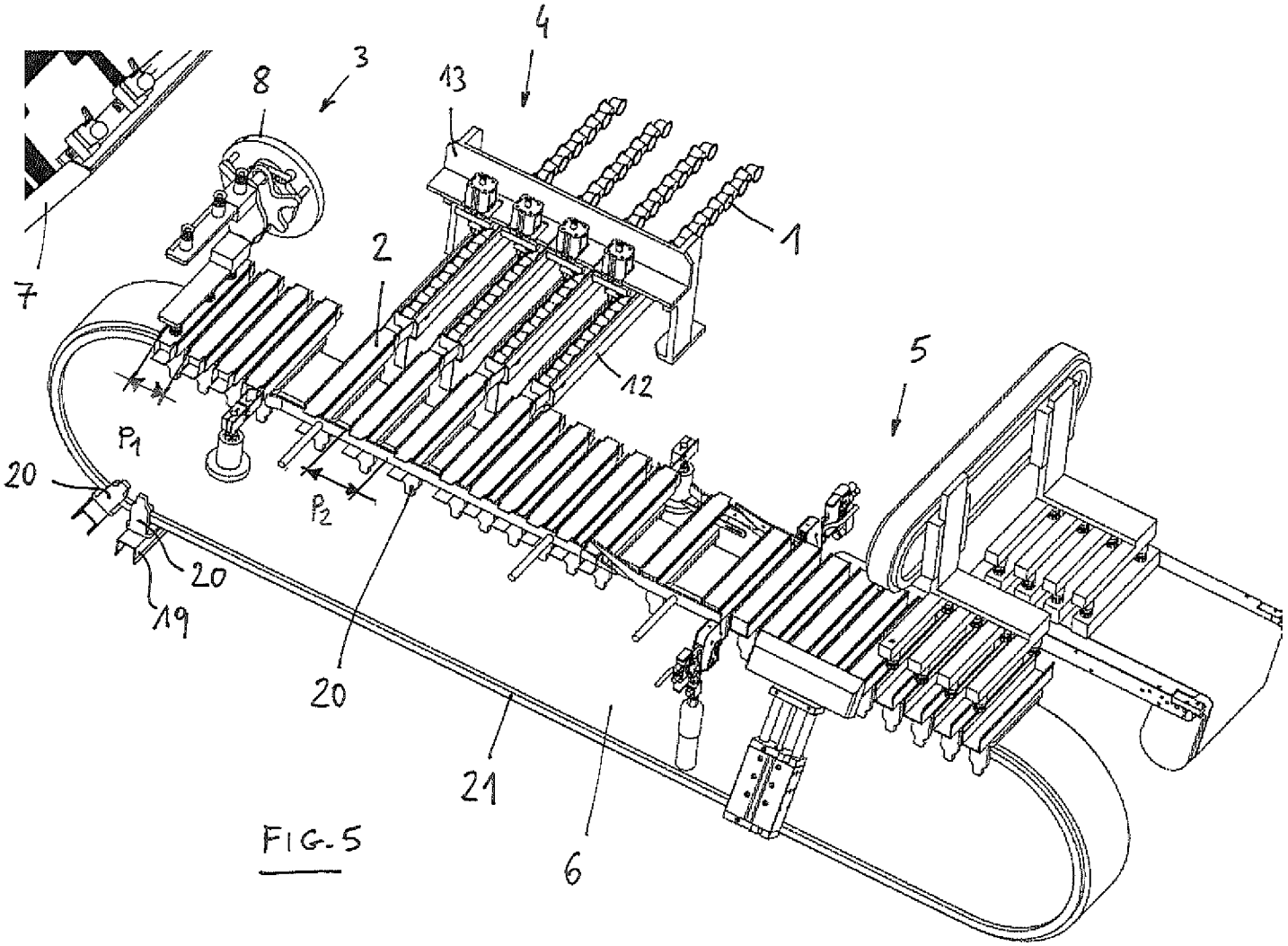
FIG. 5 is analogous to FIG. 1 and refers to an implementation with the technique of linear sliders transportation systems.

FIG. 5 shows an example embodiment of the invention with the linear sliders technique. For the sake of simplicity, the same reference numerals of FIGS. 1-4 are used in FIG. 5.

The conveyor 6 in this case is implemented with a transportation system with sliders 20 (also called movers), which are movable along a path defined by a track 21. Each slider 20 carries at least one pocket 19 for a respective case 2. Each slider 20 can be driven automatically by a control system of the conveyor itself. The track 21 is able to impart traction to the sliders 20 in a magnetic way. The traction of the sliders 20 is given, for example, by linear motors in the form of electrical windings incorporated in the track 21, which cooperate with magnets fixed to sliders 20.

In this embodiment the sliders are driven so as to form trains substantially equivalent to those of the machine of FIG. 1, for example the previously mentioned trains I, II, III and IV. It can be noted that sliders 20 can be driven singularly and they can form groups at any distance from one another. As a consequence the pitch is variable: for example FIG. 5 shows a pitch p1 between the case-carrying pockets in the forming area 3 smaller than the pitch p2 during loading in section 4. The possible dynamic variation of pitch represents a further degree of freedom of the embodiment with linear sliders.

Returning now to FIG. 1, the machine operates in the following manner. A generic train in the forming section 3, that is in the position of the train I in the figure, is advanced with a continuous movement, suitably synchronised with the feeding device 8 which forms the cases 2 and places them in the pockets 19 separated by a pitch p (FIG. 2). Said pitch p is the machine-pitch that is constant in the embodiment of FIG. 1.

Once the four cases have been loaded, said train of pockets is advanced to the position II. In said position II, the train is stopped to align the four cases 2 with the feed tracks 12. The mobile carriage 13, at this stage, performs the grabbing of an N-th capsule for each row, through the members 14, and then advances in the direction A, thus positively pushing four rows of N capsules into the four open cases 2 in the loading area.

It can be assumed, for example, that the cases are sized to house ten capsules each. The mobile carriage 13 grips the tenth capsule of each row and, with a single stroke, loads 40 capsules in four cases containing ten each.

In some embodiments, the train II can advance with intermittent movement during the loading, if for example the load comprises two insertion steps. For example insertion in a first group of cases and then in a second group of cases can be provided. In such a case the train takes a first position aligning the first cases with the input tracks 12, and subsequently advances by a pitch bringing the seconds cases in alignment with said tracks 12. In each case, the insertion is performed while the cases 2, intended to receive the articles, are stationary in the loading section 4 of the machine.

Once loading is completed, the train is advanced towards the closing section 5. In the position III, namely at the sub-section 15, the forward movement is preferably a continuous movement. In said sub-section 15, one or more groups for applying glue, mounted at the sides of the conveyor 6, apply a preset amount of glue on the edges of the cases 2. The actual closing of the cases 2 occurs in the sub-section 16 when the train is in the position IV in the figure. Preferably, the forward movement of the train in said sub-section 16 is intermittent and may be advantageously synchronised with mobile closing members, if provided.

The sealed cases 2 leaving the section 5 are delivered to a conveyor 30, which is generally outside the machine. The sealed cases 2 for example are conveyed to another device of a packaging line, for example to a palletizer to be grouped and packed into larger boxes.

It should be noted that the machine operates simultaneously on the various trains on the conveyor 6. For example, with reference to the situation of FIG. 1, in a given instant of time the train I advances with continuous movement to serve the feeding device 8, the train II simultaneously is waiting in the loading section 4, and the trains III and IV advance along the closing section 5.

The version of FIG. 5 substantially operates in an analogous manner, the case-carrying pockets being transported by the sliders 20 instead of belts 17.

In both the embodiments of FIGS. 1 and 5, the compact size of the machine can be noted, particularly in length. The bulk of the machine in substance coincides with a single conveyor 6 extending between the forming section 3 and the closing section 5, which serves the continuous formation of cases and the static or intermittent loading.

The invention claimed is:

1. A side loading machine for packaging articles in containers, the side loading machine comprising:

a containers forming section from die-cuttings, the containers forming section including at least one feeding device;

a loading section suitable for loading the articles into the containers;

a closing section of the containers;

wherein the containers forming, loading, and closing sections are substantially aligned along a longitudinal direction of the side loading machine;

a conveyor that extends continuously on a single closed two-way path between the containers forming section and the closing section, the conveyor includes a linear slider system including a plurality of sliders actuated by linear motors on a defined track, the linear motors including at least one coil incorporated therein;

a plurality of transportation members running on the single closed path of the conveyor, each of the transportation members being configured to carry at least one of the containers, each of the plurality of transportation members comprises at least one magnet and the conveyor further including a propulsion system arranged to selectively propel each of the plurality of transportation members independently from each other along the single closed two-way path;

wherein:

the at least one feeding device of the containers forming section is controlled to operate with a continuous motion and with a constant rate over time effective to form a continuous formation of containers;

the propulsion system is controlled to impart to the transportation members a continuous advance motion while traveling through the containers forming section to receive the containers from the at least one feeding device;

the propulsion system is controlled to keep the transportation members stationary in the loading section during the loading of articles into the containers while the propulsion system continuous advances the transportation members in the containers forming section;

the magnetic track of the conveyor imparts traction to the plurality of transportation members; and the at least one magnet and the at least one coil are configured to advance each of the plurality of transportation members responsive to energizing the at least one coil; and a control system controlling:

the at least one feeding device of the containers forming section to operate with the continuous motion and with the constant rate of the time effective to form the continuous formation of container;

the propulsion system to impart to the transportation members the continuous advance motion while the transportation members travel through the containers forming section and keep the transportation members stationary in the loading section.

2. The side loading machine according to claim 1, wherein the loading section includes at least one insertion member arranged for inserting articles from an accumulation area into respective containers located on the conveyor in a loading section, and wherein the transportation members or groups of transportation members are stopped in correspondence of the loading section, during a period of time when the at least one insertion member introduces a given number of articles directly from the accumulation area of the machine into respective containers.

3. The side loading machine according to claim 2, wherein the accumulation area is represented by the end section of one or more feeding tracks of the articles.

4. The side loading machine according to claim 1, wherein the closing section includes a first sub-section for applying glue to the containers, and a second sub-section for closing the containers, and the side loading machine operates so that the transportation members or groups of transportation members:

exiting from the loading section, advance with continuous movement through the first sub-section; and leaving the first sub-section, advance with intermittent movement through the second sub-section.

5. The side loading machine according to claim 1, wherein the conveyor includes a conveyor with multiple pockets including at least two sets of pockets fixed to two respective conveyor belts motorised in an independent manner, each of the multiple pockets being configured to carry one or more of the containers.

6. The side loading machine according to claim 1, wherein the conveyor includes at least four channels so that at least four transportation members or groups of transportation members of the conveyor can be driven in an independent manner.

7. The side loading machine according to claim 1, further comprising:

a plurality of feed tracks substantially parallel and adjacent to one another to feed articles arranged in a row; and an insertion group arranged to transfer a number N of articles for each row, from the feed tracks directly into the containers lying on the conveyor in a loading area, the insertion group comprising a mobile carriage equipped with gripping members arranged to grab an N-th article of each feed track, to push rows of N articles into respective containers.

8. The side loading machine according to claim 1, configured for packaging coffee capsules into cases.

9. A method for packaging articles into containers by a side loading packaging machine, the method comprising:

starting from die-cuttings, forming containers continuously with a constant rate over time;

depositing the containers on a corresponding one of a plurality of transportation members of a conveyor advancing with a continuous movement, the conveyor including a linear slider system including a plurality of sliders actuated by linear motors on a defined track, the linear motors including at least one coil incorporated therein, the track imparts traction to the plurality of transportation members;

advancing each of the plurality of transportation members independently from each other along a single closed two-way path by energizing the at least one coil;

while depositing the containers on the corresponding one of the plurality of transportation members of the conveyor advancing with a continuous movement, stationary loading of the articles into the containers, by side insertion, the stationary loading being carried out while at least one of the plurality of transportation members of the conveyor and respective containers are stopped at a loading section of the side loading machine; and closing the containers;

wherein the forming, loading, and closing steps being carried out in respective forming, loading, and closing sections of the machine.

10. The method according to claim 9, further comprising:

advancing of the containers or groups of the containers with a continuous movement during a step of applying glue; and advancing of the containers or groups of the containers with intermittent movement during a step of closing the containers.

11. The method according to claim 9, wherein the articles are capsules for preparing hot or cold drinks.

12. The method according to claim 9, wherein the articles are capsules for preparing capsules for coffee.

* * * * *